US005201783A

United States Patent [19]

Peters

[11] Patent Number: 5,201,783

[45] Date of Patent: Apr. 13, 1993

[54] PLANAR DRAFTING INSTRUMENT

[76] Inventor: Mark R. Peters, 2012 W. Hadden Ave., #3, Chicago, Ill. 60622-3604

[21] Appl. No.: 753,924

[22] Filed: Sep. 3, 1991

[51] Int. Cl.[5] ..... B43L 7/027; B43L 7/033

[52] U.S. Cl. ..... 33/474; 33/482

[58] Field of Search ..... 33/474, 482, 429

[56] References Cited

U.S. PATENT DOCUMENTS

| | | | |
|---|---|---|---|
| 827,989 | 8/1906 | Noble | 33/474 |
| 2,401,265 | 5/1946 | Nash | 33/474 |
| 3,375,589 | 4/1968 | Dolgorukov | 33/474 |
| 4,974,330 | 12/1990 | Covert | 33/474 |
| 4,999,922 | 3/1991 | Loggins | 33/474 |

*Primary Examiner*—Thomas B. Will

[57] ABSTRACT

The drafting instrument of the invention (10) disclosed herein generally compromises a planar body in a quadrilateral, symmetrical form, having four perimeter sides (22,24,26 and 28), interconnected end to end to form a quadrilateral configuration and show an open space (40) in the interior of the body, and of which two pairs of sides are right angles to each other and positioned opposite and symmetrical to each other on the planar body. The instrument is provided in two primary embodiments, the first, adapted from a 45 degree triangular instrument, where side intersections of the present invention comprises a 135 degree, a 90 degree, a 45 degree and a 90 degree interior angle, respectively and the second adapted from a 30/60 degree triangular instrument, where side intersections of the present invention comprise a 150 degree, a 90 degree, a 30 degree and a 90 degree interior angle, respectively. The instrument is provided with a handle (18) that is integrally formed near the intersection of two of the perimeter sides on the planar body and extends perpendicular from the planar body, and in the preferred embodiment of the invention, the handle (18) is provided with a groove or rigid structure at its outer most edge for permitting easy indexing and pivoting with handle (18) to aid in reversing the instrument from side to side. The instrument includes a plurality of support points (38) extending outwardly from one face (16) of the instrument only, to permit pivoting and to support the instrument slightly above the surface upon which it is used.

9 Claims, 2 Drawing Sheets

PLANAR DRAFTING INSTRUMENT

FIELD OF THE INVENTION

The present invention generally relates to the field of drafting instruments, and in its preferred embodiments, adapts from a triangular drafting instrument primarily intended for use in conjunction with a T-square or horizontal bar, establishing limited contact between the instrument and the drafting surface, providing a handle for easy use, and establishing the capability of efficient use with minimal manipulation of the instrument.

BACKGROUND OF THE INVENTION

The scribing of horizontal and vertical lines relative to the orientation of the drafting work or drawing are the two most common operations in the practice of drafting. Horizontal lines are generally produced with the aid of a T-square or horizontal bar, and vertical lines are generally produced with the aid of a right triangle in conjunction with a T-square or horizontal bar. These triangles are generally used to produce a line at the commonly needed angles of 30 degrees, 45 degrees, or 60 degrees from the horizontal, and are most commonly available in 30–60 degree and 45 degree models. Despite their almost universal use, such triangles are subject to several disadvantages and problems, especially when used for the production of vertical lines. The majority of these problems stem from the fact that these triangles must be constantly flipped from one face to another face to produce the commonly needed angles. The draftsperson must constantly reposition and reverse the standard drafting triangles in order to scribe complimentary or reverse angles. This problem is especially true of the 30-60-90 degree triangle and having to flip it from face to face reducing the efficiency of the draftsperson. As a result of this need to flip the triangles from one face to another face came the need to develop a handle or method of gripping the triangle from flat drawing surfaces. This necessity often created strained working conditions and reduced the efficiency of the draftsperson. In addition, the full contact between the face of the triangle and the drawing surface often produces smearing of both graphite or ink lines on the drawing as the triangle is slid over those lines, so it is necessary for the draftsperson to position the triangle so that it is not placed directly over the last and most recently drawn lines.

There have been various approaches to try and solve these problems and they are known in the prior art, but all of these attempted solutions fall short of a combined solution addressing the real problem; the problem of efficient maneuvering and of needing to flip the triangle from one face to another face. Some beginning attempts would include L-shaped drafting instruments as illustrated by British Patent No. 386,883 and French Patent No. 730,763. They are known in the art and do alleviate some of the problems associated with the standard drafting triangle. Those instruments are, however, directed at producing an instrument capable of creating certain specific angles. Similarly, various triangle designs have been proposed, such as those illustrated by U.S. Pat. Nos. 482,023, and 4,545,130, for primarily providing an instrument capable of creating multiple angles and curves. U.S. Pat. No. 827,989 attempted to alleviate some of the problems for efficient maneuvering and no flipping of the instrument, but fell short of the combined solution because the instrument and handle did not perform in an efficient manner due to the fact that the handle location was not efficient for pivoting the instrument, hence not efficient for control. But all of the above mentioned patents still lack in solving the basic problem of efficiently maneuvering and of needing to flip the triangle from face to face.

Some solutions to try and alleviate the need of having to flip the triangle from one face to another face would include U.S. Pat. Nos. 3,555,657, and 3,375,589, which both provides a method of manufacturing a triangle with an edge for grasping with fingers, while yet another solution as illustrated by U.S. Pat. No. 4,443,953 provides a handle that can be attached to either face of the triangle, but these designs lack in efficiency still another attempted solution is illustrated by U.S. Pat. No. 4,999,922, which provides a handle for convenience but has an unnecessarily complicated shape and is not for use in pivoting and controlling instrument. Still another attempted solution is illustrated by U.S. Pat. No. 4,821,424, which provides a handle that slides through the triangle to be grasped from face to face. These designs are useful in providing a means of more readily grasping the drafting instrument with which they are used, and are meant to alleviate problems associated with flipping the instrument from face to face but again do not address the initial problem of needing to flip the instrument from face to face which results in the draftsperson being less efficient. French patent No. 1,385,756, shows the use of raised points on the face of a T-square or triangle to raise the instrument above the surface of the drafting work, which alleviates certain normal disadvantages of the use of a triangular instrument, but the design stops short of a coordinated solution to the full scope of problems associated with a triangular instrument.

It is an object of the present invention to provide a fully coordinated approach to the solution of the problems associated with the use of a standard drafting triangle without negating the advantageous features of a triangular drafting instrument by providing an initial solution that would free the standard triangular drafting instrument of superfluous features. Further, it is also the object of the present invention to provide a triangular drafting instrument with a combination of necessary features directed to performing a drafting work in a highly efficient manner.

SUMMARY, OBJECTIVES AND ADVANTAGES OF THE INVENTION

Each embodiment of the drafting instrument of the present invention generally comprises a quadrilateral integrally formed symmetrical planar body having four perimeter sides interconnected at their ends to form a symmetrical quadrilateral configuration of the body with an open space in the interior of the body. In the preferred embodiment of the invention, two sets of the perimeter sides form right angles relative to each other and these right angles are positioned symmetrical and opposite to each other on the body. The body of each instrument is derived from a right triangle and is provided in two primary embodiments thereof, the first adapted from a 30/60 degree triangle embodiment, where the present invention comprises a 150 degree, a 90 degree, a 30 degree, and a 90 degree interior angle, reflected in its outer edges, respectively, herein referred to as a 90/30/90/150 degree embodiment of the drafting instrument. The second adapted from a 45 degree triangular embodiment, where the present invention comprises a 135 degree, a 90 degree, a 45 degree and a 90 degree interior angle, reflected in its outer edges, respectively, herein referred to as a 135/90/45/90 degree embodiment of the drafting instrument. Each embodiment of the present invention includes a plurality of small support points extending outwardly from one planar face of the instrument only, opposite the planar face of the instrument which outwardly extends the handle, for the purpose of supporting, pivoting and for sliding the instrument on the drafting surface and to minimize the surface area in contact with the body of the instrument and the drafting surface. The number of support points provided is similar to either embodiment of the present invention, and is selected to comprise a minimum number necessary to maintain a consistent stable instrument, in order to minimize the surface area contact between the instrument body and the drafting surface. The support points of the instrument serve to reduce the friction caused by sliding and pivoting the instrument on the drafting surface, both to provide a smooth stable instrument and to substantially prevent smearing or friction produced in the course of the drafting work. The most efficient use of the 150/90/30/90 degree embodiment requires that it not be needed to reverse from face to face. The 135/90/45/90 degree embodiment of the present invention may possibly be efficiently used without the need to reverse the drafting instrument from one face to another. Therefore, either embodiment of the present invention, the 150/90/30/90 degree embodiment or the 135/90/45/90 degree embodiment are provided with support points on only one face of the body, that face opposite the handle.

To further facilitate movement and control during use, each embodiment of the instrument of the present invention further includes a handle integrally formed within the planar body, near the 150 degree interior angle corner of the 135/90/45/90 degree planar instrument, and near the 135 degree interior angle corner of the 135/90/45/90 degree planar instrument. Since, in either embodiment of the instrument of the invention, reversibility from one face to another is not necessary, and support points are provided on only one face, the handle may be fixedly interconnected to the body of either embodiment so that it extends outwardly from one face, opposite the face to which the support points are interconnected. Any convenient configuration of the handle may be used, but use of the instrument is substantially more efficient if the handle is fixed to the instrument and provides proper gripping, generally in a shape so that it may be grasped between the thumb and fingers of either hand comfortably by the user. The handle will then enable the user to operate the instrument in conjunction with a T-square or horizontal bar by placing slight pressure on the handle, toward the horizontal bar and twisting the handle in a pivoting motion, giving the user far more superiority and efficiency in maneuvering the instrument. The newly configured drafting instrument of the present invention may be constructed of any suitably strong and rigid material, but use of a transparent material allows the draftsperson to view the portion of the drafting work under the instrument and contributes to its efficiency of use.

Each separate feature of the drafting instrument of the present invention provides particular distinct efficiencies in the use of the instrument, and such features are harmonious in combination, creating a highly efficient drafting instrument for the performance of drafting work. The newly configured body of the drafting instrument allows the draftsperson to produce vertical lines with the aid of a T-square or horizontal bar and all the commonly needed angles without the need to flip the instrument from one face to another face. This advantage could also prove helpful in aiding a left-handed or right-handed draftsperson without discrimination of which hand holds the instrument and which hand scribes the line with the instrument. Because of the inherent symmetrical body of the newly configured instrument, features such as support points and a handle can be reduced by half of what was previously thought to be necessary. The use of support points on one face only to raise the newly configured instrument above the drafting surface allows a draftsperson to draw an ink or graphite line along any described edge without smearing. The reduced friction created by the use of the support points and the placement of the fixed handle on the instrument allows a draftsperson to firmly grasp and control the instrument with his hands in an optimal position for the efficient performance of the drafting work. While the increase in efficiency of each movement may be small, the increase in the efficient performance will be greatly enhanced by the resolved need to reverse the instrument from one face to the other. All of the features together will increase the efficiency over the course of preparation of a complete drafting work.

The structure of the newly configured drafting instrument of the present invention of either embodiment will now be described in detail, with reference to the accompanying drawing figures.

BRIEF DESCRIPTION OF THE DRAWING FIGURES

FIG. 1: Is a plan view of the preferred 135/90/45/90 degree embodiment of the drafting instrument of the invention.

FIG. 2: Is an elevational, or edge view of the preferred embodiment of the drafting instrument of the invention.

FIG. 3: Is a sectional, or cut view of the preferred embodiment of the drafting instrument of the invention.

FIG. 4: Is a plan view of the preferred 150/90/30/90 degree embodiment of the drafting instrument of the invention.

FIG. 5 and FIG. 6: Are reduced plan views of the preferred 150/90/30/90 degree embodiment of the drafting instrument of the invention illustrating the two primary pivoting movements used, in conjunction with a horizontal surface, such as the edge of a horizontal bar, to gain all possibly needed 30 degree or 60 degree angles.

FIG. 7: Is a reduced plan view of the preferred 135/90/45/90 degree embodiment of the drafting instrument of the invention illustrating the pivoting movement used, in conjunction with a horizontal surface such as the edge of a horizontal bar, to gain all possibly needed 45 degree angles.

DETAILED DESCRIPTION AND OPERATION OF THE INVENTION

Figure 1:
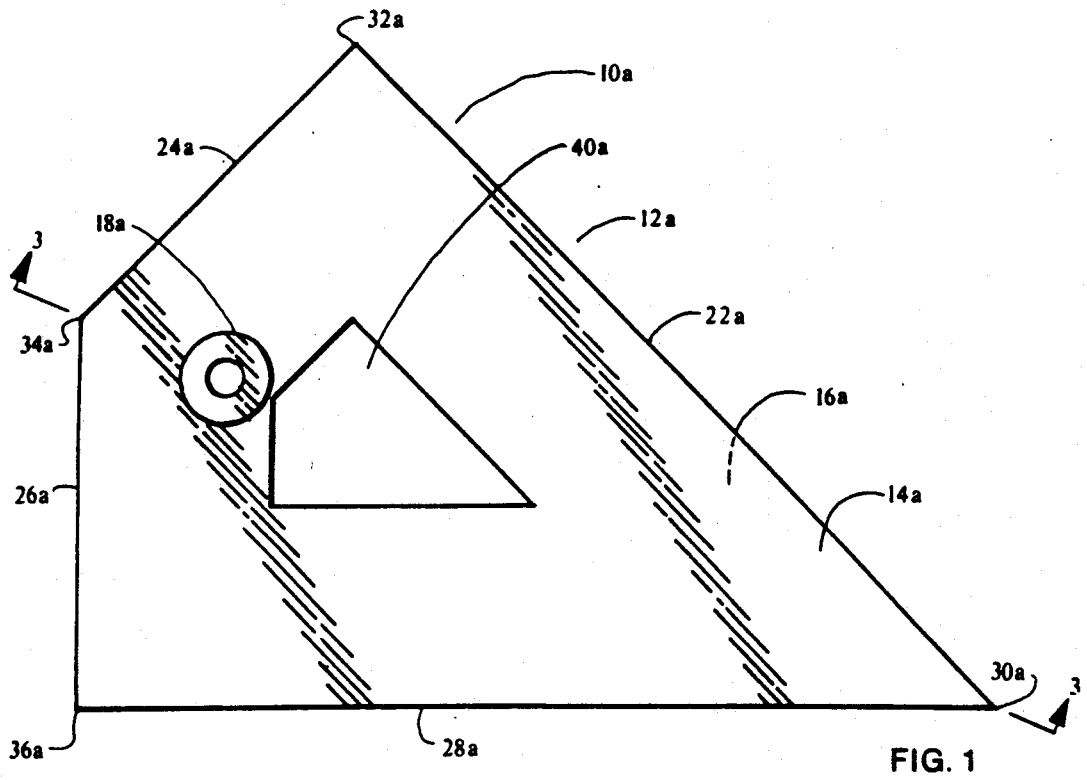

With regard to the accompanying FIGS. 1 thru 7, each of the preferred embodiments of the drafting instrument of the invention is generally designated by the reference number 10. In the proceeding description of the preferred embodiments of the invention, and in the drawing figures, "a" is used in conjunction with the reference numbers to designate components of the preferred 135/90/45/90 degree embodiment of the invention, and "b" is used in conjunction with reference numbers to designate the same components of 150/90/30/90 degree embodiment of the invention. When reference numbers are used with out the specific letter "a" or "b", it is to be understood that the descriptive reference number refers to both embodiments. For Example, reference numeral 10 generally designates the drafting instrument of the invention while reference numeral 10*a* specifically designates the 135/90/45/90 degree embodiment of the drafting instrument, and reference numeral 10*b* specifically designates the 150/90/30/90 degree embodiment of the drafting instrument.

Figure 2:
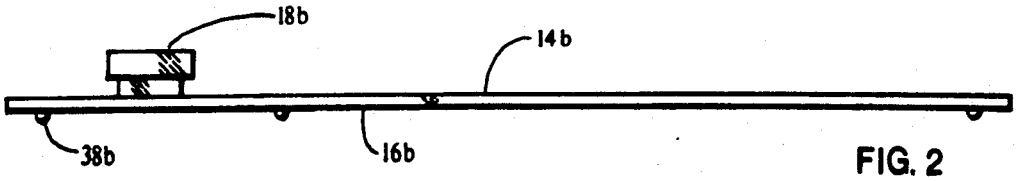
Figure 3:
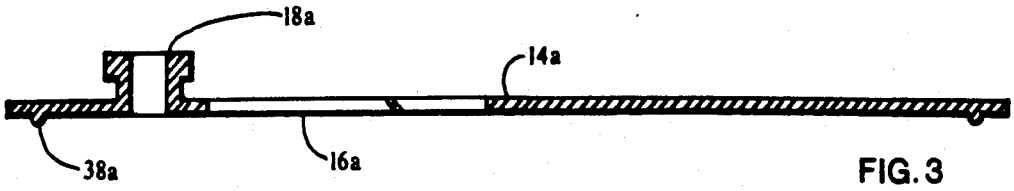
Figure 4:
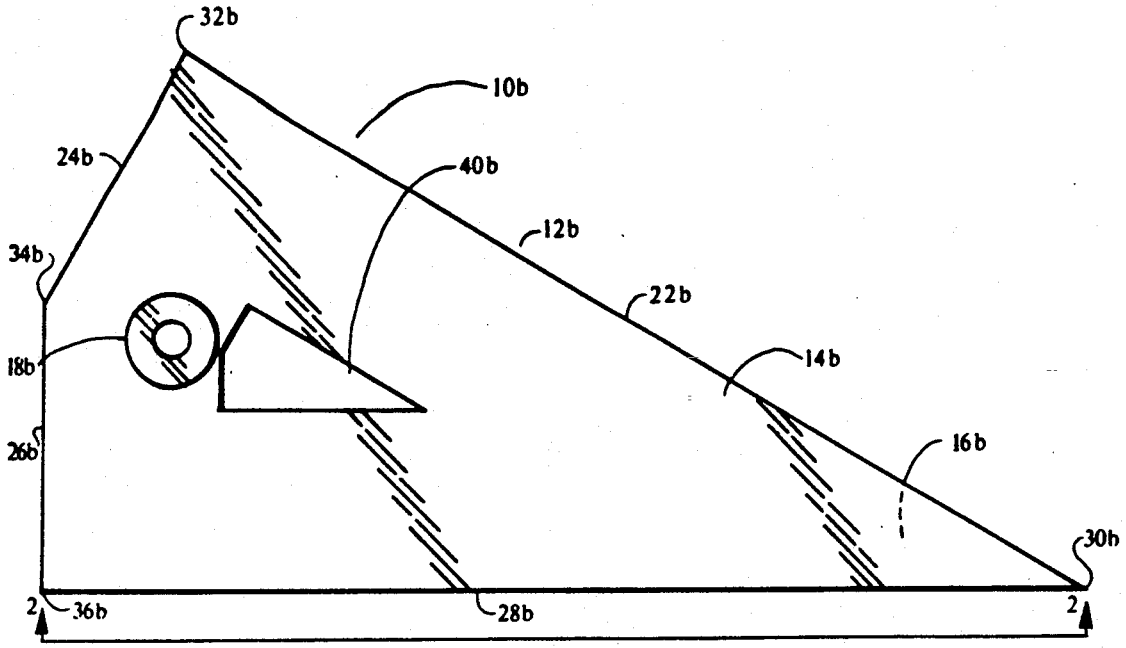

In FIGS. 1 and 4, the preferred embodiment of the drafting instrument of the invention 10, will be seen and understood to comprise a quadrilateral integrally formed symmetrical substantially planar body 12, having a integrally formed handle 18 in body 12 which has an upper face 14, and a lower face 16, includes four elongate sides; 22,24,26, and 28 respectively. The intersection of sides 22 and 24, and the intersection of sides 26 and 28 form an interior angle equal to 90 degrees. The intersection of sides 22*a* and 28*a* form an interior angle corner equal to 45 degrees, while the intersection of sides 24*a* and 26*a* form an interior angle corner equal to 135 degrees. The intersection of sides 22*b* and 28*b* form an interior angle corner equal to 30 degrees, while the intersection of sides 24*b* and 26*b* form an interior angle corner equal to 150 degrees. The external edges of sides 22 and 24 and of sides 26 and 28, which form an interior angle corner equal to 90 degrees are located opposite to each other within the planar body 12, to form a symmetrical substantially planar embodiment 12. In the preferred embodiment of drafting instrument 10*a*, external lengths of sides 22*a* and 28*a* are equal and external lengths of sides 24*a* and 26*a* are equal. In the preferred embodiment of drafting instrument 10*b*, external lengths of sides 22*b* and 28*b* are equal and external lengths of sides 24*b* and 26*b* are equal. For example, if the embodiment 10, was cut from corner 30 to corner 34 with a straight line on the planar body 12, the resulting embodiment 10, would be in two pieces, completely symmetrical to each other, and of a mirror image to each other. In the embodiment of the drafting instrument 10, sides 22, 24, 26, and 28 are of the same width within each disclosed embodiment, and each of the sides is of the same width throughout its length and when interconnected from end to end, define a quadrilateral open space 40 in the interior of body 12. Minimizing the width of leg 22, 24, 26, and 28 while still retaining rigidity results in a efficient use of material and a total weight minimization of drafting instrument 10, providing ease in maneuverability, as compared to heavier instruments, for the draftsperson. Referring to FIG. 2, body 12 of the drafting instrument 10 includes a plurality of support points 38 extending outwardly, a short distance from face 16 only, for the purpose of pivoting the instrument in operation and raising the body 12 of the drafting instrument 10 above the surface area upon which it is used. In the preferred embodiment of the drafting instrument 10, each of the support points 38 is configured as a hemisphere with a radius of approximately one sixteenth inch, and is integrally formed with body 12, but any convenient configuration, size, and means of interconnection of support points 38 to body 12 of drafting instrument 10 may be used within the spirit of the invention. The distance of the extension of each of the support points 38 from 16 of body 12 must be equal to ensure stability of drafting instrument 10 upon a drafting surface, and it is preferred that the distance of the extension of support points 38 not exceed the thickness of body 12. In the preferred embodiment of the drafting instrument 10, both versions 10*a* and 10*b* only require support points 38 on face 16 respectively, since reversibility from face 14 to face 16 is not necessary. In the preferred embodiments the total number of support points 38 is to be approximately four, located near the corners 30,32,34, and 36, but any convenient number of support points to ensure stability of drafting instrument 10, will suffice. Referring to FIGS. 1 thru 4, body 12 of the drafting instrument 10 additionally includes an integrally formed handle 18 that projects perpendicularly from body 12 from the planar face 14, opposite the planar face 16. The integrally formed handle 18 is centered on a line from corner 30 to corner 34 and is further positioned near corner 34 on the center line, on the planar body 12. In the preferred embodiment of the drafting instrument 10, handle 18 is located opposite the support points 38 on the planar body 12 since reversibility from one face to another face is unnecessary. Any convenient configuration, size, and means of interconnection of handle 18 to body 12 projecting off face 14 of drafting instrument 10 may be used within the spirit of the invention, but use of the drafting instrument 10 is substantially more efficient in the course of creation of an entire work if handle 18 is of sufficient length and is integrally connected to face 14 of body 12 to provide proper gripping X and to prevent rotation of handle 18 when used in conjunction with a horizontal bar 20, by placing slight pressure on handle 18 and twisting drafting instrument 10 in a pivoting motion, with handle 18 for desired movement of user.

Figure 5:
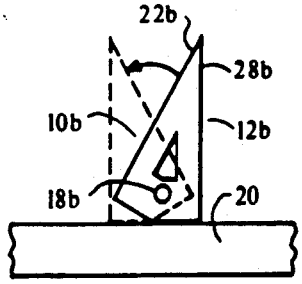
Figure 6:
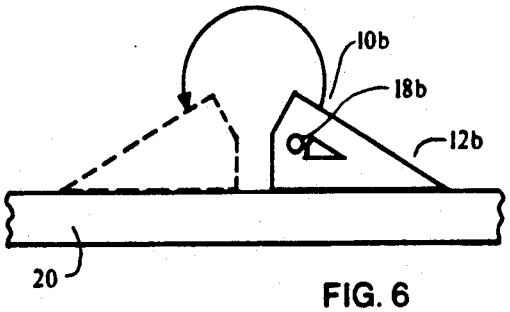
Figure 7:
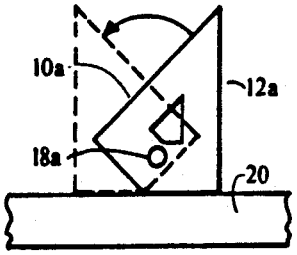

Building upon the aforementioned description, a description of the specific adaption of each of the embodiments of the drafting instrument 10 of the invention may be provided. The 45 degree embodiment 10*a*, is adapted from a typical triangle with three legs that form at the intersections, a 45 degree angle, a 90 degree angle and a 45 degree angle, which add to a total of 180 degrees. In the preferred embodiment of drafting instrument 10*a* there are four sides, 22*a*,24*a*,26*a*, and 28*a*, respectively that shape the body 12*a*. Angle intersection 30*a* is 45 degrees, angle intersection 32*a* is 90 degrees, angle intersection 34*a* is 135 degrees, and angle intersection 36*a* is 90 degrees, in which all four angle intersections add to 360 degrees. The adaption of drafting instrument 10 to provide the 30/60 degree triangular embodiment 10*b* is based on a typical triangle with three legs that form at the intersections, a 30 degree and a 90 degree angle, and a 60 degree angle, which add to a total 180 degrees. In the preferred embodiment of the drafting instrument 10*b* there are four sides 22*b*,24*b*,26*b*, and 28*b*, respectively, that shape body 12*b*. Angle intersection 30*b* is a 30 degrees, angles intersection 32*b* is 90 degrees, angle intersection 34*b* is 150 degrees, and angle intersection 36*b* is 90 degree in which all four angle intersections add up to 360 degrees. Opposite angle intersections, 30 and 34, add up to 180 degrees, while opposite angle intersections 32 and 36 add up to 180 degrees similarly, within planar body 12 of drafting instrument 10. With this quadrilateral configuration, FIG. 5, illustrates how a draftsperson may scribe a line along the external of side 22*b* or 28*b* as a 60 degree and a 90 degree line, respectively, from the conjunction with a horizontal surface, such as an edge of a horizontal bar 20 and with a quick rotation, the angle of 22*b* from the horizontal bar 20 switches from 60 degree to 90 degrees respectively, and the angle of 28*b* switches from 90 degrees to 60 degrees from the horizontal in drafting instrument 10*b*.

Adaptation of the drafting instrument 10 of the invention is preferable if reversible, however, due to the inherent symmetry of drafting instrument 10 reversibility is not essential to efficient use, and accordingly, drafting instrument 10 of the invention may be made nonreversible in either embodiment, as illustrated in FIGS. 1, 4, 5, 6, and 7, contributing to ease and economy of its

SUMMARY, RAMIFICATIONS AND SCOPE OF THE INVENTION

The aforementioned detailed description of the preferred embodiment of the drafting instrument of the invention is illustrative, and not for the purposes of limitation. Further, since numerous modifications and alternative embodiments may readily occur to those skilled in the art, it is not desired to limit the aforementioned invention to the exact construction and operation shown and described, and all suitable modifications and equivalents may be pursued without departing from the scope and spirit of the invention as claimed.

What is claimed is:

1. A drafting instrument compromising:

a quadrilateral integrally formed planar body having an upper face and a lower face, having four perimeter sides being a first, first short side with first and second ends, a second, second short side with first and second ends, a third, first long side with first and second ends, and a forth, second long side with first and second ends, with said second end of said first, first short side intersecting said first end of said second, second short side, said second end of said second short side interconnected to said first end of said third, first long side, said second end of said third, first long side interconnected to said first end of said fourth, second long side, said second end of said fourth, second long side interconnected to said first end of said first, first short side, with said first and second sides being of equal length, and said third and fourth sides being of equal length, which form the symmetrical quadrilateral configuration of the drafting instrument;

a handle integrally formed within said planar body, said handle being positioned on a center line defined by said intersection of said first, first short side, and said second, second short side and said intersection of said third, first long side, and said fourth, second long side and located rear the intersection of said first, first short side and said second, second short side, and extending outwardly from said upper face of said body, so as to provide sufficient grip and pivoting operation when used in conjunction with a T-square or horizontal bar;

a multiplicity of points extending outwardly from said lower face, with one of said points located between said intersection of said first, first short side, and second, second short side and said handle along said center line functioning for pivoting operation of said body with said handle, with all of said points extending outwardly from said lower face an equal distance so as to contact a planar surface upon which the drafting instrument is positioned with said body of the drafting instrument parallel to said planar surface.

2. The drafting instrument of claim 1, wherein said angles of said side intersections form a 150 degree, a 90 degree, a 30 degree, and a 90 degree angle, respectively.

3. The drafting instrument of claim 1, wherein said body is constructed of a durable transparent plastic material.

4. The drafting instrument of claim 1, wherein said four perimeter sides and said intersections are formed by four perimeter legs forming an open space in interior of said planar body.

5. The drafting instrument of claim 2, wherein said body of said drafting instrument is symmetrically constructed with said handle and said points in plane of said body.

6. The drafting instrument of claim 2, wherein said handle is provided with a ridge or groove at its outermost edge for sufficient grip in maneuverability of pivoting operation.

7. The drafting instrument of claim 1, wherein said angles of said side intersections form a 135 degree, a 90 degree, a 45 degree, and a 90 degree angle, respectively.

8. The drafting instrument of claim 7, wherein said body of said drafting instrument is symmetrically constructed with said handle and said points in plane of said body.

9. The drafting instrument of claim 7, wherein said handle is provided with a ridge or groove at its outermost edge for sufficient grip in maneuverability of pivoting operation.

* * * * *